US007559127B2

(12) United States Patent
Rooney et al.

(10) Patent No.: US 7,559,127 B2
(45) Date of Patent: Jul. 14, 2009

(54) SHOE CLIP

(75) Inventors: James Rooney, Cochrane (CA); Kipling Fyfe, Cochrane (CA); Ken Fyte, Edmonton (CA); Wade Bortz, Canmore (CA)

(73) Assignee: Garmin Ltd. (KY)

( * ) Notice: Subject to any disclaimer, the term of this patent is extended or adjusted under 35 U.S.C. 154(b) by 171 days.

(21) Appl. No.: 11/600,382

(22) Filed: Nov. 16, 2006

(65) Prior Publication Data

US 2007/0089322 A1 Apr. 26, 2007

Related U.S. Application Data

(63) Continuation of application No. 10/181,403, filed as application No. PCT/CA01/00040 on Jan. 19, 2001, now Pat. No. 7,152,286.

(30) Foreign Application Priority Data

Jan. 21, 2000 (CA) ..... 2296780

(51) Int. Cl.
*A43C 11/00* (2006.01)

(52) U.S. Cl. ..... 24/712; 36/136; 24/712.6

(58) Field of Classification Search ..... None
See application file for complete search history.

(56) References Cited

U.S. PATENT DOCUMENTS

| | | | | |
|---|---|---|---|---|
| 1,616,694 | A | 2/1927 | Hoppe | |
| 4,536,975 | A * | 8/1985 | Harrell | 36/136 |
| 6,122,340 | A | 9/2000 | Darley et al. | |
| 6,536,139 | B2 | 3/2003 | Darley et al. | |
| 7,200,517 | B2 | 4/2007 | Darley et al. | |

OTHER PUBLICATIONS

Office Action dated Aug. 21, 2007 from the Canadian Intellectual Property Office for Canadian Application Serial No. 2,396,998 entitled Shoe Clip.

* cited by examiner

*Primary Examiner*—Jack W. Lavinder
(74) *Attorney, Agent, or Firm*—Samuel M. Korte

(57) ABSTRACT

A shoe clip (100) includes two members (10, 12) that attach together in positions above and beneath shoe laces (20), to grip the shoe laces (20) between them and position the clip (100) on the shoe (22). A first member (10) is shaped and sized to slide under one or more laces (10) of the shoe, without requiring unlacing thereof. A second member (12) rotatably attaches at one end to the first member and, after insertion of the first member (10) beneath the laces (10), rotates to overlie the first member (10). The members then fasten to one another at their free ends (15, 17), such that the members grip the laces (20) between them. The second member supports or is integral with a component that is to be attached to the shoe.

14 Claims, 6 Drawing Sheets

SHOE CLIP

CROSS-REFERENCE TO RELATED APPLICATIONS

The present application is a continuation of U.S. patent application Ser. No. 10/181,403, filed Jul. 18, 2002, now U.S. Pat. No. 7,152,286 which was the National Stage of International Application No. PCT/CA01/00040, filed Jan. 19, 2001. U.S. patent application Ser. No. 10/181,403 is herein incorporated by reference in its entirety.

BACKGROUND OF THE INVENTION

1. Field of the Invention

The invention relates to a shoe clip and, in particular, a shoe clip for attachment of articles to the laces, straps or other fastening devices of a shoe.

2. Background Information

It is often desired to attach small components, such as coins, keys, identification race chips, computational devices and/or electronic devices to the laces, straps or like devices of boots, sandals, running-shoes and so forth. Hereinafter, the various types of shoes will be included in the term "shoe" and the various types of laces, straps and so forth will be included in the term "laces." The attaching of the components to the shoe in this manner relieves the user from carrying the components in his or her hand or carrying the components in various pockets. For some components, such as, the race chip or certain computational devices or electronic devices, attachment to the shoe is required for the proper functioning of the component.

Prior known shoe attachment mechanisms consist mainly of simple shoe lace tie-in devices that have lace holes built into them. To use the devices, the user unlaces the shoe lace from three or four eyelets, runs the lace through the lace holes of the attachment mechanism and then re-runs the lace through the eyelets. This method is particularly bothersome, however, because the shoe must be continuously unlaced and laced when the device is placed on or taken off of the shoe. Further, the fit of the shoe may be adversely affected if the laced sides of the shoe do not compensate for the extra bulk of the attached components.

Other known attachment mechanisms, such as Velcro loops, do not provide a sufficiently rigid connection between the component and the laces. Accordingly, the component moves around on the laces when a user moves, and the movement of the component may thus distract the user or adversely affect the performance of the device.

SUMMARY OF THE INVENTION

The invention is a shoe clip that includes two releasably and/or rotatably attached members that essentially grip the laces, to position the clip on the shoe. A first member is shaped and sized to slide under one or more laces of the shoe, without requiring unlacing thereof. A second member attaches at one end to the first member. After insertion of the first member underneath the laces, the second member is positioned over the first member, such that the laces are held between the two members. The members may then fasten to one another at or near their free ends, such that the members grip the laces relatively tightly between them. The second member supports or is integral with the component that is to be attached to the shoe. The clip thus holds component in position on the laces such that the movement of the component relative to the laces is minimized.

DETAILED DESCRIPTION OF AN ILLUSTRATIVE EMBODIES

It is to be understood that laced or strapped footwear including, for example, boots, sandals and running shoes are collectively referred hereinafter as shoes. Further, the term laces as used hereinafter includes straps and other like devices.

Figure 1:
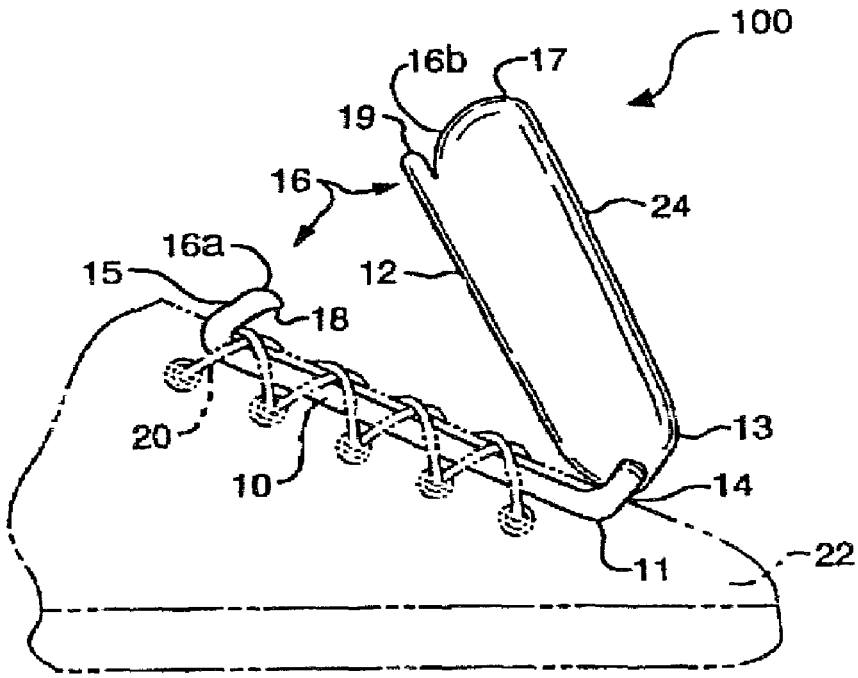
FIG. 1 is a side elevation view of a shoe clip according to the present invention installed on a shoe in preparation for clipping thereto.
Figure 2:
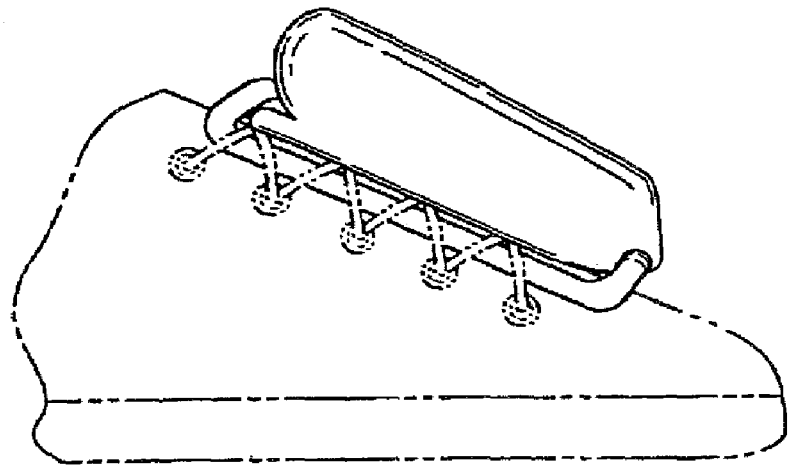
FIG. 2 is a side elevation view of the shoe clip of FIG. 1 clipped on the shoe.

Referring to FIGS. 1 and 2, the shoe clip 100 includes a first member 10 and a second member 12 that are rotatably connected at first ends 11 and 13 by a hinge 14. The hinge is disposed to permit the second member to rotate away from the first member, as shown in FIG. 1, and to a position that overlays the first member, as depicted in FIG. 2. Co-acting sections 16*a* and 16*b* of a fastening device 16, such as, for example, a catch or a snap, are positioned on free ends 15 and 17 of the members. The fastening device releasably secures the second member in the position in which it overlays the first member. In this closed position, the members then grip the one or more laces 20 between them.

The second member 12 may be formed integral with a component 24 such as a pouch, race clip or electronic device, as depicted in the drawing. Alternatively, the component may be supported by the second member.

As depicted in FIGS. 1 and 2, the free end 15 of the first member 10 extends outwardly and is sized and shaped to receive the free end 17 of the second member 12. The free end of the second member includes an outwardly extending tab 19 that is sized to catch against a lip 18 of the shaped end of the first member when the clip is in the closed position as shown in FIG. 2. The lip 18 prevents the second member from rotating away from the laces.

The shoe clip 100 may instead be positioned on the shoe with the free ends facing the toe of the shoe. Further, the tab 19 may extend outwardly from the free end of the first member and be received by the free end of the second member. Alternatively, the tab 19 and shaped end may be fashioned as a snap, with the tab extending upwardly or downwardly, as appropriate. The hinge 14 may be releasable, such that the members may be pulled apart as opposed to or in addition to rotating relative to one another.

Figure 3A:
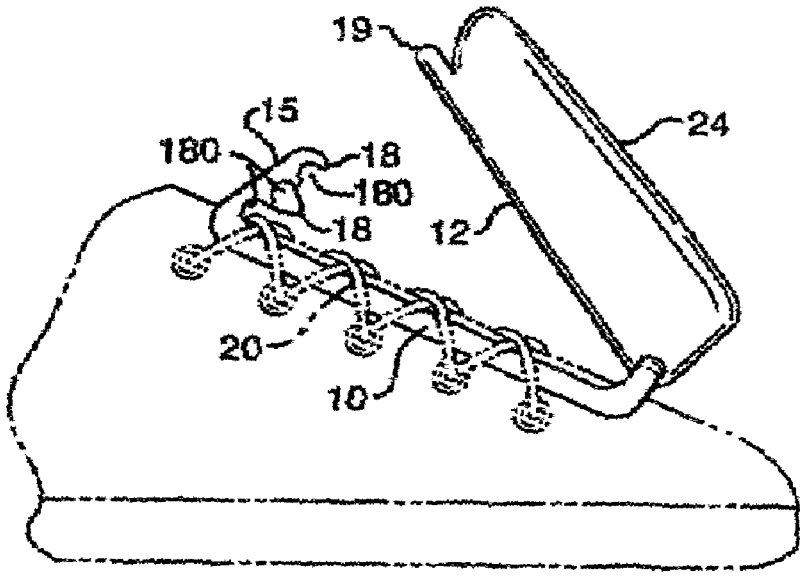
FIGS. 3*a* and 3*b* are side elevation views of the shoe clip of FIG. 1 with additional fastening slots on a first member or a second member.
Figure 3B:
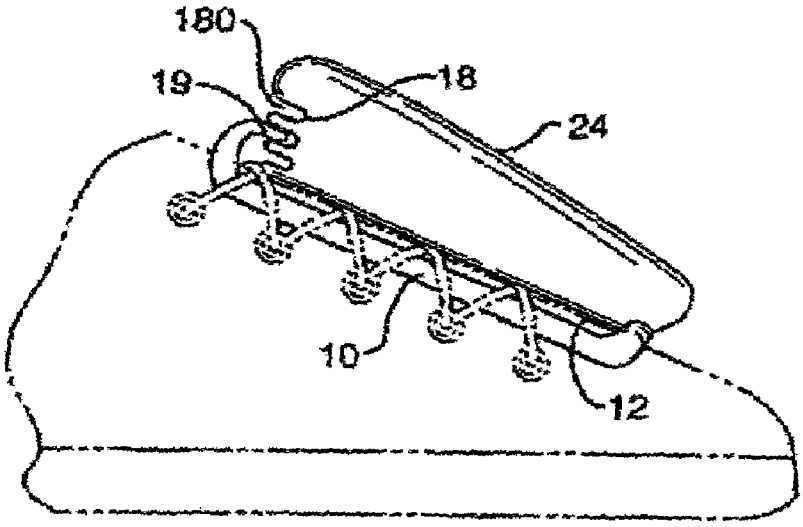

Referring also to FIGS. 3*a* and 3*b* the receiving end of member 10 or 12 may be further shaped to receive the tab 19 in any one of a number of indents 180, each with a projecting lip 18. The second member may thus be held selectably closer to or further from the first member depending on the thickness of the laces 20. With the first member in position over the second, the user pushes the first member toward the second member until the tab 19 rests in an appropriate indent 180, such that the members then grip the laces relatively tightly and hold the component 24 securely and rigidly in position on the shoe. Alternatively, the clip may include multiple tabs 19 and one or more receiving indents.

To facilitate sliding the first member 10 beneath the laces, the laces may be loosened. The laces, however, need not and, indeed, should not be unlaced. When the laces are thereafter tightened and tied, the first member is rotated and fastened, to hold the component 24 rigidly in place. As discussed, the free end of the one of the members may include multiple indents 180 for receiving the free end of the other member such that the grip on the laces 20 can be selectively tightened to accommodate the thickness of the laces.

Figure 4:
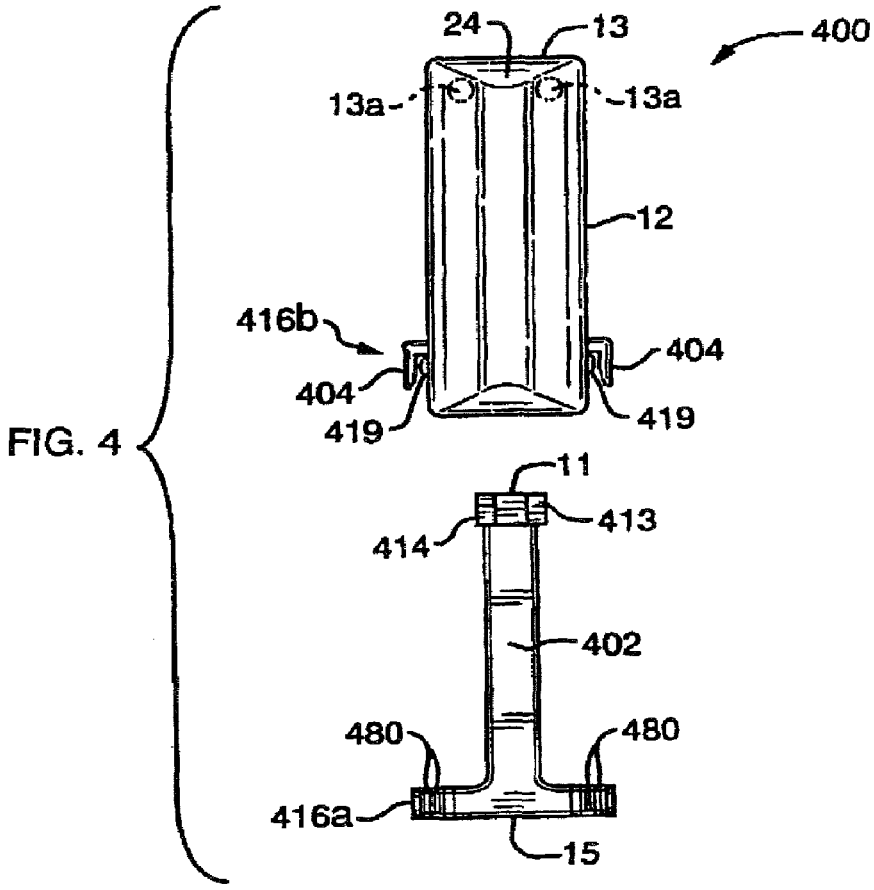
FIG. 4 is an exploded top view of an alternate arrangement of the shoe clip of FIG. 1.
Figure 5:
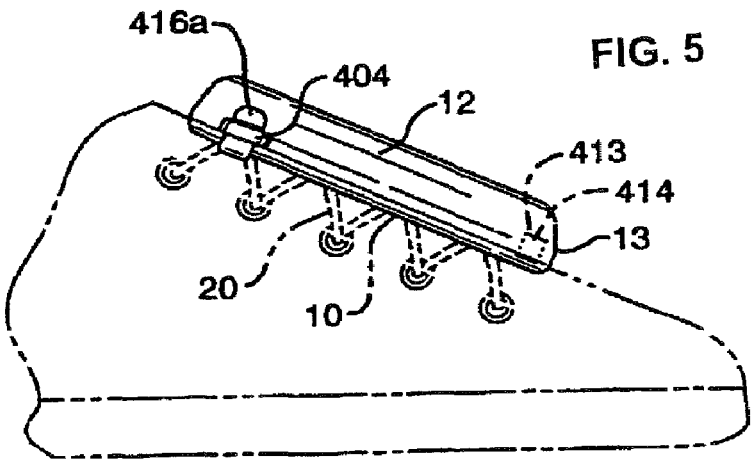
FIG. 5 is a side elevation view of the shoe clip of FIG. 4.

Referring now to FIGS. 4 and 5, the first member 10 includes at its free end 15 a cross bar 402 that has two shaped ends 416*a*. The shaped ends engage tabs 419 that extend outwardly on either side of the second member 12. The shaped ends may include multiple slots 480 for receiving the tabs 419, such that the grip of the members can be adjusted around the laces 20. The hinge 414 is shown as including two pivot points 413 that engage indents 13*a* at the end 13 of the second member. The second member then rotates relative to the first member about the pivot points.

Alternatively, the two members may releasably attach at their ends 11 and 13, with points 413 being received in the indents 13*a* when the second member is positioned to overlay the first member. The ends 11 and 13 may instead be held together magnetically with one or both of the points the indents being magnetized. Further the tabs may extend inwardly from the arms 404, with the indents 480 being located on the outside of the ends 416*a* of the crossbar.

Figure 6:
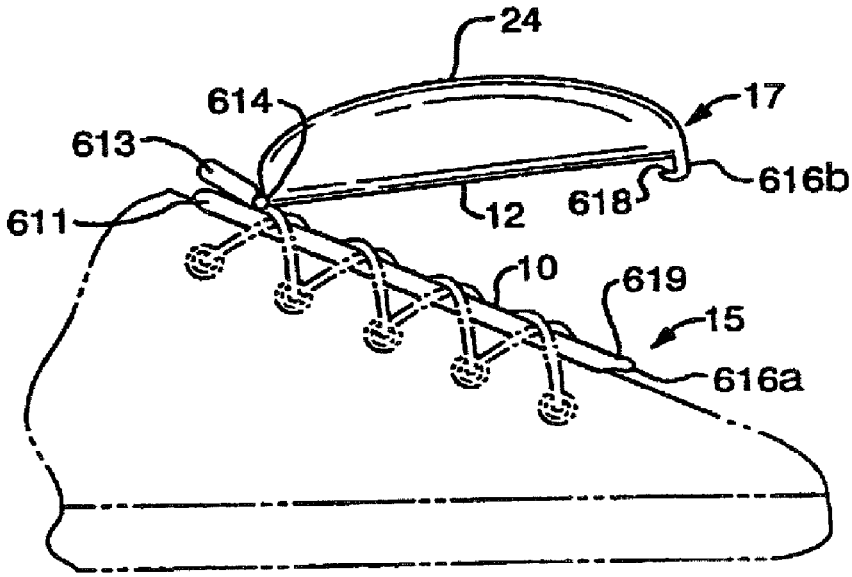
FIGS. 6 and 7 are side elevation views of another alternate arrangement of the shoe clip of FIG. 1.
Figure 7:
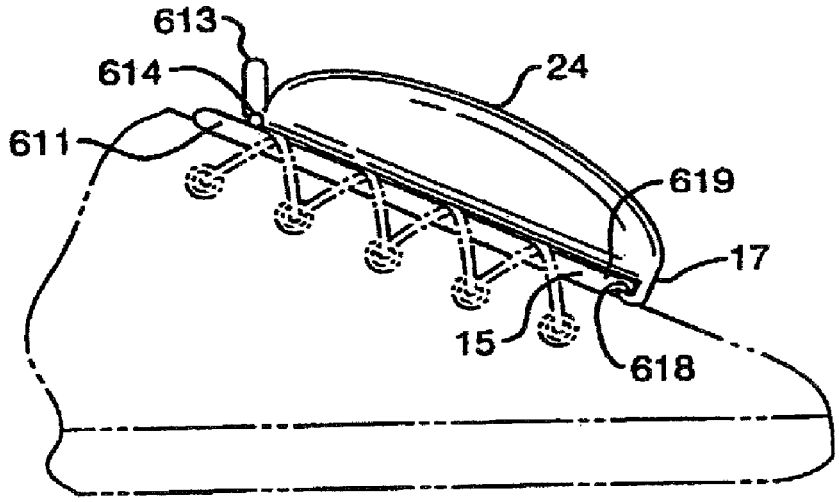

FIGS. 6 and 7 depict the shoe clip 600 with a spring hinge 614 that rotatably connects the first and second members 10 and 12. The free ends of the members fasten together with the receiving end 616*b* of the second member engaging a tab 619 on the end of the first member. A lip 618 holds the receiving end of the second member against movement.

A user positions the clip 600 on the shoe by pressing the hinged ends 611 and 613 together such that the members 10 and 12 separate, against the urging of the spring hinge 614. The user then slides the first member under the laces 20 while holding the hinged ends against further relative movement of the members. The user then releases the hinged ends and one or both of the members move in accordance with the urging of the spring hinge, until the second member overlies the first member. As appropriate, the user pushes the second member closer to the first member to engage the free ends 15 and 17.

Figure 8:
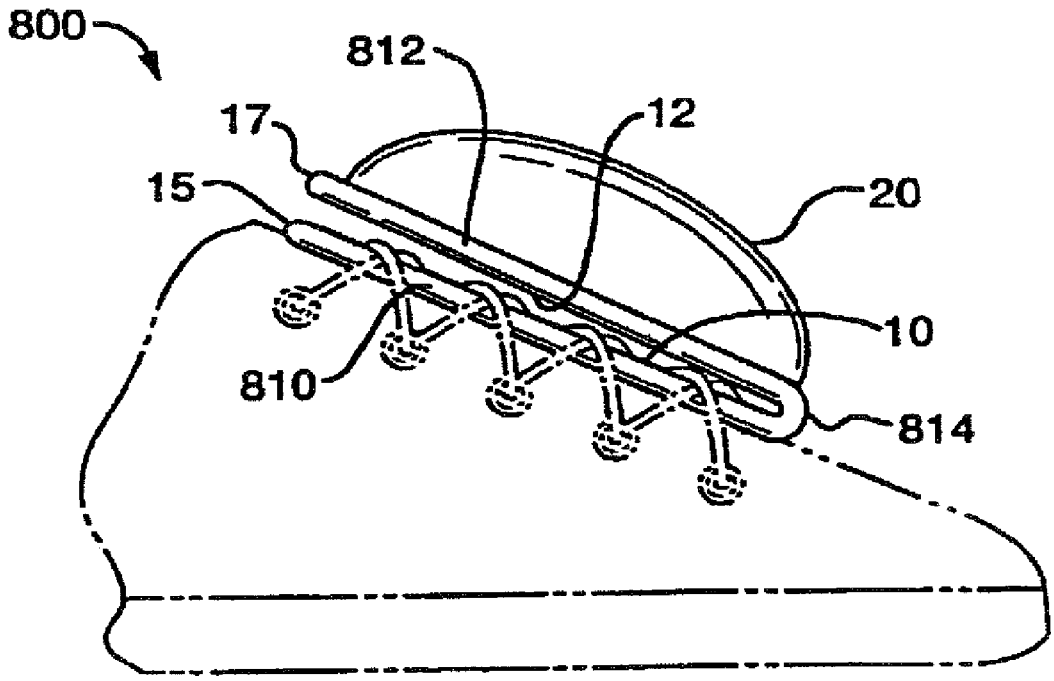
FIG. 8 is a side elevation of another alternative arrangement of the shoe clip of FIG. 1.
Figure 9:
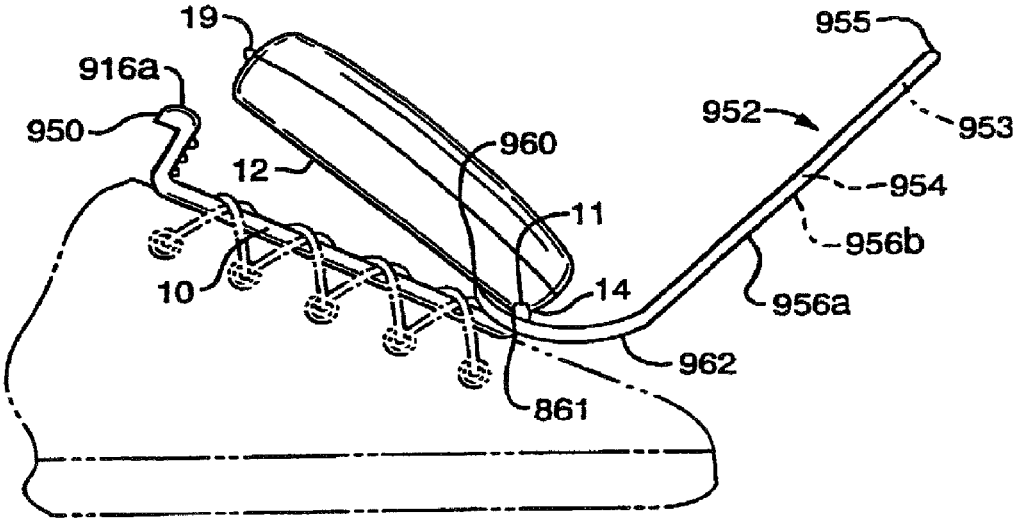
FIGS. 9 and 10 are side elevation views of the shoe clip of FIG. 1 with an additional elastic retainer band.
Figure 10:
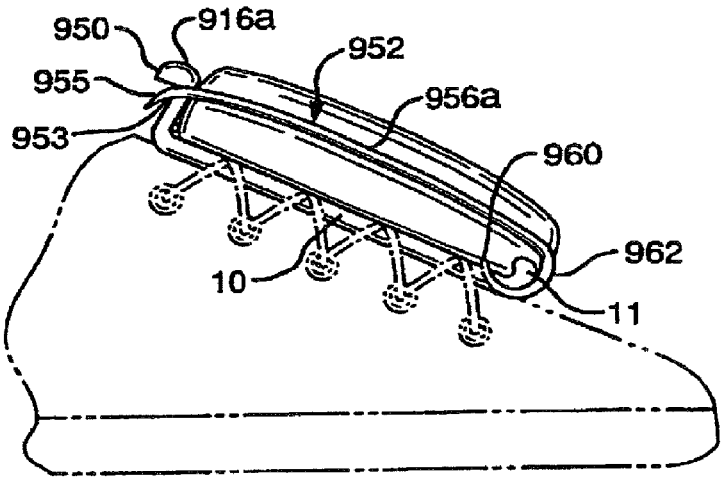

Referring now to FIG. 8, the shoe clip of FIG. 1 may be one-piece and U-shaped, with legs 810 and 812 that form the first and second members 10 and 12 and a closed end 814 that acts as a spring-controlled hinge. The legs or members are mechanically stressed such that they apply pressure to one another in accordance with the urging of the spring-controlled end 814. A user thus pulls the free ends 15 and 17 of the legs slightly apart and slides the clip onto the laces, with one leg beneath the laces and one leg above the laces. The user then releases the legs, and the legs move in accordance with the urging of the hinge 14, to clamp onto the laces. The members thus tightly grip the laces between them, to hold the component rigidly in place on the laces. The free ends of the legs may also fasten together with any of the catches, snaps and so forth discussed above. Referring now to FIGS. 9 and 10, the shoe clip of FIG. 1 is depicted with an additional elasticized retainer band 952. The band attaches at one end 960 to the member 10 adjacent to the hinge 14. As depicted in the drawing, the end 960 includes a first opening 961 that slides over the end 11 of the first member. The band 952 includes a second, elongated opening 954 that essentially separates the band into two sections 956*a* and 956*b* along much of the length of the band, leaving a tab 955 as the free end of the band.

When the shoe clip is in the closed position, as depicted in FIG. 10, the user stretches the retainer band 952 over the component 24 such that the end 953 of the opening 954 fits over a shaped end 916*a* of the first member 10. The shaped end 916*a* includes an outwardly extending projection 950 that retains the end 955 of the band 952 in position over the component. With the clip in the closed position, a section 962 of the band essentially protects the component, should the user kick or trip over something.

The elasticized retainer band 952 may also aid in holding the component 24 in place relative to the first member 10 particularly if the fastening device should fail. The shoe clip has several distinct advantages over the previously discussed shoe attachment devices. Two such advantages are: (i) the laces do not need to be unlaced when attaching or removing the device; and (ii) the attached device has a secure and rigid fit on the shoe because of the manner in which the members of the clip grip the laces between them.

Numerous modifications, variations and adaptations may be made to the particular embodiments of the invention described above without departing from the scope of the invention as defined in the claims. As discussed, the free ends of the members may be closest to the tie ends of the laces or to the toe of the shoe, the hinge 14 may be a catch, a pivot, a spring, releasable and/or rotational. Further the two members may be legs of a one-piece U-shaped clip or may be separate pieces that releasably and/or rotatably attach to one another at the hinged end. Further, the fastening device 16 on the free ends of the members may be a tab and one or more indent combination, a catch, snap or velcro fastener and the like, that holds the free ends of the device in a position in which the members to grip the laces between them and hold the component against movement relative to the laces.

The invention claimed is:

1. A shoe clip including:

A. a component to be held in place on a shoe;

B. a first member that is shaped to slide beneath one or more shoe laces, the first member having first and second ends;

C. a second member that is positioned to overlie the first member, the second member having first and second ends and a middle for supporting the component;

D. a hinge that attaches the first ends of the first and second members, wherein the hinge includes a pivot point about which the second member rotates relative to the first member and the hinge biases the members toward one another; and E. a fastening device that releasably locks the second member in the overlaid position relative to the first member with the one or more laces gripped between the members and the component positioned above the laces, and holding the component against movement relative to the shoe, wherein the laces are rigidly gripped between the members along the length of the members.

2. The shoe clip of claim 1 wherein the second member is integral with the component to be positioned on the shoe.

3. The shoe clip of claim 1 wherein the clip is U-shaped and a. the first and second members are legs, and b. the hinge is integral with the legs and forms a spring connection between the first ends of the legs.

4. The shoe clip of claim 1 wherein the hinge rotatably attaches the first ends of the first and second members.

5. A method for mounting an article to a shoe having one or more laces, the method including the steps of:

A. first sliding a first member between the one or more laces and the shoe until a second end of the first member extends outwardly from the one or more laces;

B. second positioning a second member that is integral with or supports the article to overlay the first member with the one or more laces between the two members; and C. third rigidly clamping the two members together to grip the one or more laces tightly between the members and secure the article in position on the shoe and against movement relative to the shoe, wherein the laces are rigidly clamped between the members along the length of the members.

6. The method of claim 5 wherein the step of positioning the second member includes rotating the second member about a hinge that interconnects first ends of the first and second members.

7. The method of claim 5 wherein a. the step of positioning the second member further includes pushing the second member closer to the first member until the laces are tightly gripped, and b. the step of fastening the two members includes retaining the members in the relative positions in which they tightly grip the laces.

8. The method of claim 5 further including wherein a. a step of separating a first member and a second member by rotating one member relative to the other member before the first member slides beneath the laces; and b. wherein the step of positioning the second member includes rotating the members relative to one another until the second member overlies the first member.

9. The method of claim 5 wherein:

i. the step of separating the members includes moving the members against the urging of a spring hinge; and ii. the step of positioning the members includes releasing the members to rotate in accordance with urging of the spring hinge.

10. A shoe clip including:

a component to be held in place on a shoe;

a first member that is shaped to slide beneath one or more shoe laces, the first member having first and second ends;

a second member that is positioned to overlie the first member, the second member having first and second ends and a middle for supporting the component;

a hinge that attaches the first ends of the first and second members;

a fastening device that releasably locks the second member in the overlaid position relative to the first member with the one or more laces gripped between the members and the component positioned above the laces, and holding the component against movement relative to the shoe; and wherein the clip is U-shaped and the first and second members are legs, and the hinge is integral with the legs and forms a spring connection between the first ends of the legs.

11. A shoe clip including:

a component to be held in place on a shoe;

a first member that is shaped to slide beneath one or more shoe laces, the first member having first and second ends;

a second member that is positioned to overlie the first member, the second member having first and second ends and a middle for supporting the component;

a hinge that attaches the first ends of the first and second members;

a fastening device that releasably locks the second member in the overlaid position relative to the first member with the one or more laces gripped between the members and the component positioned above the laces, and holding the component against movement relative to the shoe; and wherein the fastening device further includes a crossbar on the second member, and arms on the second end of the second member, the arms shaped to receive the ends of the crossbar.

12. The shoe clip of claim 11 wherein i. the crossbar includes on either end an outwardly extending tab, ii. the arms include one or more slots for receiving the tabs.

13. A shoe clip including:

a component to be held in place on a shoe;

a first member that is shaped to slide beneath one or more shoe laces, the first member having first and second ends;

a second member that is positioned to overlie the first member, the second member having first and second ends and a middle for supporting the component;

a hinge that attaches the first ends of the first and second members;

a fastening device that releasably locks the second member in the overlaid position relative to the first member with the one or more laces gripped between the members and the component positioned above the laces, and holding the component against movement relative to the shoe; and wherein the first member is shaped at the first end to retain a second end of an elasticized retainer band, and the elasticized retainer band includes a first end and the second end and between the first and second ends is split with the first and second legs that extend along opposite sides of the component when the members are in the overlaid position and the second end of the retainer band is held by the first end of the first member.

14. A method for mounting an article to a shoe having one or more laces, the method including the steps of:

A. first sliding a first member between the one or more laces and the shoe until a second end of the first member extends outwardly from the one or more laces;

B. second positioning a second member that is integral with or supports the article to overlay the first member with the one or more laces between the two members, said positioning including rotating the first member with respect to the second member about a hinge having a discrete pivot point; and C. third rigidly clamping the two members together to grip the one or more laces tightly between the members and secure the article in position on the shoe and against movement relative to the shoe.

* * * * *